US008844743B2

(12) United States Patent
Costa

(10) Patent No.: US 8,844,743 B2
(45) Date of Patent: Sep. 30, 2014

(54) CONTAINER CAP

(76) Inventor: Giuseppe Costa, Villafranca Tirrena (Me) (IT)

( * ) Notice: Subject to any disclaimer, the term of this patent is extended or adjusted under 35 U.S.C. 154(b) by 98 days.

(21) Appl. No.: 13/518,939

(22) PCT Filed: Dec. 23, 2010

(86) PCT No.: PCT/US2010/062066

§ 371 (c)(1),
(2), (4) Date: Sep. 25, 2012

(87) PCT Pub. No.: WO2011/079301

PCT Pub. Date: Jun. 30, 2011

(65) Prior Publication Data

US 2013/0008901 A1 Jan. 10, 2013

Related U.S. Application Data

(60) Provisional application No. 61/290,162, filed on Dec. 24, 2009.

(51) Int. Cl.

| | |
|---|---|
| ***B65D 1/02*** | (2006.01) |
| ***B65D 47/26*** | (2006.01) |
| ***B65D 47/32*** | (2006.01) |
| ***B65D 51/16*** | (2006.01) |

(52) U.S. Cl.

CPC ..... *B65D 1/0292* (2013.01); *B65D 47/32* (2013.01); *B65D 51/1644* (2013.01); *B65D 47/265* (2013.01); *Y10S 215/90* (2013.01)

USPC ..... 220/253; 220/666; 220/200; 220/254.1; 220/580; 220/578; 215/900; 215/381; 215/382; 215/261; 222/92; 222/206; 222/209; 222/107; 222/387; 222/386; 141/114; 141/313; 141/337

(58) Field of Classification Search

CPC ..... B65D 35/00

USPC ..... 220/253, 666, 256, 495.01, 200, 254.4, 220/713, 578, 580; 215/900, 381, 261, 260, 215/231, 14; 222/92, 209, 207, 159, 386.5, 222/386, 387, 107; 141/114, 313, 337; 206/524.8; 53/510

See application file for complete search history.

(56) References Cited

U.S. PATENT DOCUMENTS

| | | | | |
|---|---|---|---|---|
| 892,716 | A * | 7/1908 | Sanford | 220/303 |
| 1,631,931 | A * | 6/1927 | Geake | 222/104 |

(Continued)

FOREIGN PATENT DOCUMENTS

EP 0849186 A1 6/1998

*Primary Examiner* — Mickey Yu
*Assistant Examiner* — Gideon Weinerth
(74) *Attorney, Agent, or Firm* — Browdy and Neimark, PLLC

(57) ABSTRACT

A compressible container (200) has a cap (100) configured to engage therewith. The cap (100) includes a first valve (150), preferably in the form of first and second disks (112,120), one above another, each disk having at least one hole (113,122) therethrough. The disks are rotatable with respect to one another The holes (113,122) of the first and second disks (112,120) align in a first position to create channel therethrough and misalign in the second position to close the channel. The cap (100) may also include a second valve (130) connected to the channel. The second valve (130) may comprise a ball (134) inside a conic section tube (132). The ball (134) is designed to float on the liquid (300) so that any liquid (300) attempting to exit the container cap (100) will be prevented from doing so as the second valve (130) will be closed when the liquid forces the ball (134) into engagement with the conic section tube (132).

6 Claims, 5 Drawing Sheets

(56) References Cited

U.S. PATENT DOCUMENTS

| | | | | | |
|---|---|---|---|---|---|
| 1,668,895 | A | * | 5/1928 | Fulton | 222/213 |
| 1,742,183 | A | * | 1/1930 | Bell | 417/211 |
| 1,752,085 | A | * | 3/1930 | Hinkle | 222/210 |
| 2,575,056 | A | * | 11/1951 | Eynon | 248/103 |
| 2,686,006 | A | * | 8/1954 | Hasselquist | 417/437 |
| 2,725,087 | A | * | 11/1955 | Potter | 206/598 |
| 2,751,953 | A | * | 6/1956 | Grimm | 383/3 |
| 2,764,155 | A | * | 9/1956 | Meyers | 215/11.4 |
| 2,886,084 | A | * | 5/1959 | Davison | 220/666 |
| 2,979,236 | A | * | 4/1961 | Morris | 222/207 |
| 3,012,695 | A | * | 12/1961 | Lerner | 222/129 |
| 3,083,877 | A | * | 4/1963 | Gash | 222/107 |
| 3,143,429 | A | * | 8/1964 | Swanson et al. | 426/117 |
| 3,146,919 | A | * | 9/1964 | Chappell | 222/212 |
| 3,179,300 | A | * | 4/1965 | Davidson et al. | 222/213 |
| 3,231,139 | A | * | 1/1966 | Bouet | 222/95 |
| 3,376,868 | A | * | 4/1968 | Mondiadis | 604/133 |
| 3,390,821 | A | * | 7/1968 | Mullan | 222/212 |
| 3,474,936 | A | * | 10/1969 | McDonnell | 222/211 |
| 3,587,937 | A | * | 6/1971 | Childs | 222/213 |
| 3,620,240 | A | | 11/1971 | Bogdanski | |
| 3,672,114 | A | * | 6/1972 | Sacks | 53/88 |
| 3,828,806 | A | * | 8/1974 | Glos, II | 137/111 |
| 3,833,154 | A | * | 9/1974 | Markowitz | 222/212 |
| 4,044,836 | A | * | 8/1977 | Martin et al. | 169/30 |
| 4,087,024 | A | * | 5/1978 | Martin et al. | 222/211 |
| 4,249,583 | A | * | 2/1981 | Lundbladh | 141/65 |
| 4,330,072 | A | * | 5/1982 | Mastman | 222/209 |
| 4,429,811 | A | * | 2/1984 | Bakeman | 222/159 |
| 4,438,869 | A | * | 3/1984 | Vierkotter et al. | 222/1 |
| 4,456,134 | A | * | 6/1984 | Cooper | 215/341 |
| 4,592,492 | A | * | 6/1986 | Tidmore | 222/209 |
| 4,640,426 | A | * | 2/1987 | Wasley | 215/228 |
| 4,684,033 | A | * | 8/1987 | Marcus | 215/269 |
| D292,555 | S | * | 11/1987 | Chesterfield | D9/683 |
| 5,058,778 | A | * | 10/1991 | Weinstein | 222/209 |
| 5,137,183 | A | * | 8/1992 | Mikulec et al. | 222/192 |
| 5,178,300 | A | * | 1/1993 | Haviv et al. | 222/95 |
| 5,323,589 | A | * | 6/1994 | Linner | 53/432 |
| 5,328,060 | A | * | 7/1994 | Kersten et al. | 222/209 |
| 5,366,115 | A | * | 11/1994 | Kersten et al. | 222/105 |
| 5,406,992 | A | * | 4/1995 | Miramon | 141/65 |
| 5,524,795 | A | * | 6/1996 | Lee | 222/207 |
| 5,553,745 | A | * | 9/1996 | McMillian | 222/92 |
| 5,642,826 | A | * | 7/1997 | Melrose | 215/382 |
| 5,792,126 | A | * | 8/1998 | Tribastone et al. | 604/319 |
| 5,967,377 | A | * | 10/1999 | Glynn | 222/158 |
| 6,062,437 | A | * | 5/2000 | Mascitelli | 222/212 |
| 6,274,209 | B1 | * | 8/2001 | Pagidas et al. | 428/35.7 |
| 6,286,725 | B1 | * | 9/2001 | Gerber | 222/207 |
| 6,484,897 | B1 | * | 11/2002 | Crawley | 215/307 |
| 6,588,617 | B1 | * | 7/2003 | Majcen et al. | 220/254.4 |
| 6,845,876 | B2 | * | 1/2005 | Helms, Jr. | 220/234 |
| 7,527,179 | B2 | * | 5/2009 | Haimi | 222/401 |
| 7,819,263 | B1 | * | 10/2010 | DiCarlo-Nelson | 215/11.3 |
| 7,993,304 | B2 | * | 8/2011 | Kriesel et al. | 604/134 |
| 8,042,714 | B2 | * | 10/2011 | Miyazaki et al. | 222/494 |
| 8,069,987 | B2 | * | 12/2011 | Choy et al. | 206/524.8 |
| 8,251,262 | B2 | * | 8/2012 | Peckels | 222/476 |
| 8,534,478 | B2 | * | 9/2013 | Mays et al. | 215/381 |
| 8,573,402 | B2 | * | 11/2013 | Cimino | 206/524.8 |
| 8,684,230 | B1 | * | 4/2014 | Greenberg | 222/107 |
| 2002/0066714 | A1 | * | 6/2002 | Mainquist et al. | 215/261 |
| 2003/0066561 | A1 | * | 4/2003 | Christman | 137/433 |
| 2004/0069740 | A1 | * | 4/2004 | Athalye | 215/381 |
| 2005/0051510 | A1 | * | 3/2005 | Varasteh | 215/382 |
| 2005/0061764 | A1 | * | 3/2005 | Tamashiro | 215/12.1 |
| 2006/0043092 | A1 | * | 3/2006 | Alfonso | 220/254.4 |
| 2007/0000859 | A1 | * | 1/2007 | Pedulla et al. | 215/381 |
| 2007/0145000 | A1 | * | 6/2007 | Musalek | 215/381 |
| 2009/0001041 | A1 | * | 1/2009 | Belcastro | 215/228 |
| 2009/0200339 | A1 | * | 8/2009 | Quinlan et al. | 222/190 |
| 2009/0218008 | A1 | * | 9/2009 | Law | 141/311 R |
| 2010/0193460 | A1 | * | 8/2010 | Driver et al. | 215/11.3 |
| 2010/0293900 | A1 | * | 11/2010 | Waldron | 53/510 |
| 2011/0139826 | A1 | * | 6/2011 | Hair et al. | 222/214 |
| 2011/0290826 | A1 | * | 12/2011 | Harris | 222/319 |
| 2013/0062347 | A1 | * | 3/2013 | Webster et al. | 220/253 |
| 2013/0214009 | A1 | * | 8/2013 | Bakhos | 222/209 |
| 2013/0334259 | A1 | * | 12/2013 | White | 222/386 |
| 2014/0014613 | A1 | * | 1/2014 | Matsch | 215/231 |
| 2014/0102042 | A1 | * | 4/2014 | Krieg et al. | 53/403 |

* cited by examiner

CONTAINER CAP

FIELD OF THE INVENTION

The present invention is in the field of collapsible containers for containing liquids to be dispensed and to caps for such containers. More specifically, the present invention is in the field of hand held collapsible containers for containing liquids to be dispensed and to the construction of caps for such containers.

BACKGROUND OF THE INVENTION

Many liquids that are stored in sealed containers, such as alcoholic beverages, fruit juices and dairy products (e.g. milk), rapidly deteriorate upon exposure to oxygen after the sealed containers are opened.

The introduction of "bag in a box wine" (wherein the wine is contained in a collapsible plastic bag held in a cardboard box and dispensed through a valve at the bottom of the container, closed with a plastic cap) addressed both the problem of oxygen intrusion and the problem of adequate closure after initial opening. But such a container structure has limitations in its practical use since the valve prevents a user from enjoying pouring the wine from the collapsible plastic bag into a second container, such as a goblet. Instead, the wine must be dispensed from the plastic bag in an upright position. The same problem applies to any other liquid contained in such kind of container.

On the other hand, today's supermarkets and shops sell beverages such as carbonated drinks in increasingly large volumes. The containers of these beverages are usually plastic bottles, and generally hold up to around 3 liters of liquid, although there is no reason why larger containers cannot be used. However, a problem with carbonated drinks, especially those stored in large containers, is that once the containers have been opened and a quantity of the beverage is consumed, the quality of the beverage, i.e. the degree of carbonation, causing the effervescence or "fizzyness," and hence the taste, of the beverage remaining in the container, diminishes over a relatively short period of time. This is because consuming the beverage increases the space in the container for gases, and the increase of the space changes the gas/liquid pressure equilibrium between the beverage and the space. As a result, the carbon dioxide in the beverage escapes quickly into the increased space and the carbon dioxide concentration in the beverage decreases. As the beverage keeps being consumed, there is eventually only a negligible amount of carbon dioxide remaining in the beverage and the beverage remaining in the container has lost its desired taste and/or become undrinkable.

SUMMARY OF THE INVENTION

In accordance with the present invention, the problems of the prior art are solved in that a cap is provided for a compressible container, which cap contains a first valve that allows air to be expelled when the container is collapsed, and does not allow the air to return to the container after the collapsing operation. In a preferred embodiment, the cap contains a second valve that permits air to be expelled when the first valve is open, but does not allow liquid to pass therethrough.

An apparatus in accordance with the present invention includes a compressible container having an opening, and a compressible surface such that the container may be capable of being compressed to reduce its volume, and a cap according to the present invention, configured to engage with the opening of the container. The compressible container may be used for storing a quantity of a liquid and allows the liquid to be poured out from the opening when the cap according to the present invention is disengaged from the compressible container.

The cap according to the present invention may comprise a channel connecting the inside of the compressible container to the outside of the apparatus; and at least a first disk and a second disk with one above the other, each disk having at least one hole therethrough. The first disk is rotatable with respect to the second disk between a first position and a second position. The holes of the first and second disks align with each other in the first position to open the channel and the holes of the first and second disks misalign to each other in the second position to close the channel.

In a further embodiment, the cap according to the present invention may include a device that prevents liquid from exiting the cap once the container is collapsed to the extent that all or most of the gas, such as air or $CO_2$, therein has been expelled through the channel in the cap. In this regard, the cap may comprise a second valve within the channel. The second valve preferably comprises a conic section tube and a ball inside the conic section tube. The conic section tube preferably comprises a first end having a first diameter and a second end having a second diameter. The first diameter is preferably smaller than the second diameter and larger than the diameter of the ball. The second end of the conic section tube connects to one of the first and second disks. The ball preferably has a density smaller than the density of the liquid.

In yet another embodiment the cap and the container include the second valve discussed above but not the first valve.

BRIEF DESCRIPTION OF THE DRAWINGS

The above and other features and advantages will become more apparent by describing in detail example embodiments thereof with reference to the attached drawings in which.

DETAILED DESCRIPTION OF EMBODIMENTS

Figure 1:
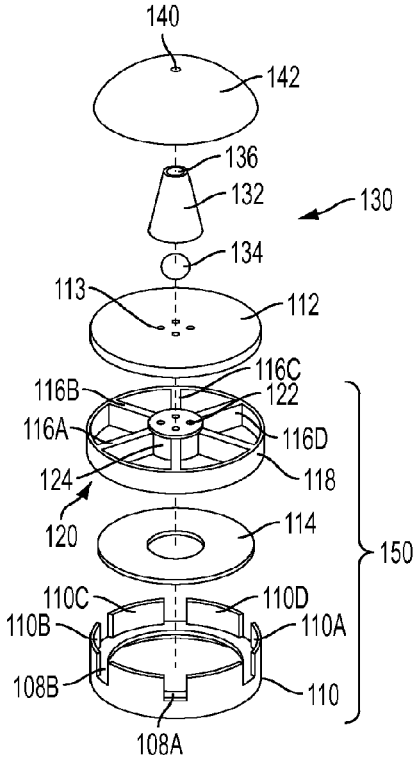
FIG. 1 illustrates an exploded perspective view of the container cap, according to an embodiment of the present invention, viewed from an angle above the horizontal.
Figure 3:
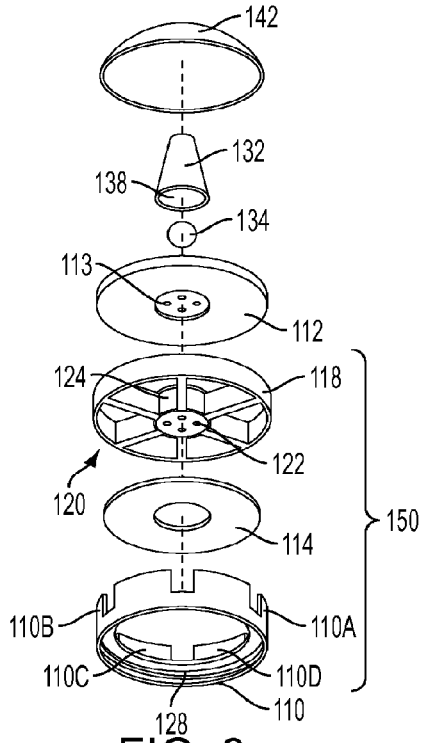
FIG. 3 illustrates an exploded perspective view of the container cap, according to the embodiment of the present invention, viewed from an angle below the horizontal.
Figure 2:
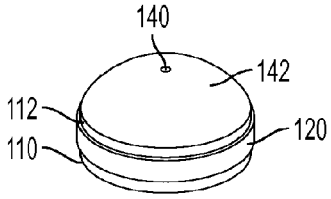
FIG. 2 illustrates a perspective view of an assembled container cap, according to an embodiment of the present invention, viewed from an angle above the horizontal.
Figure 4:
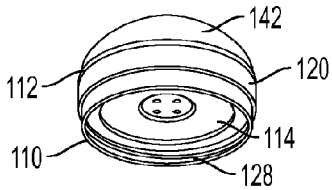
FIG. 4 illustrates a perspective view of an assembled container cap, according to an embodiment of the present invention, viewed from an angle below the horizontal.
Figure 5:
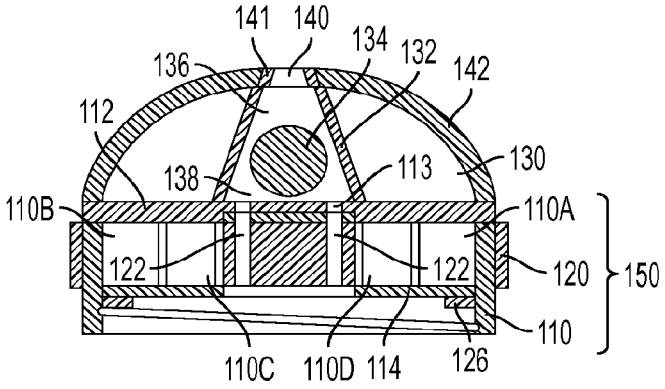
FIG. 5 illustrates a cross-sectional view of the container cap according to an embodiment of the present invention.
Figure 6:
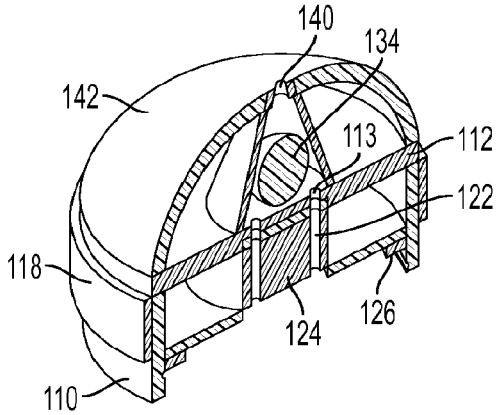
FIG. 6 illustrates a cross-sectional perspective view of the container cap according to an embodiment of the present invention, viewed from an angle above the horizontal.
Figure 7:
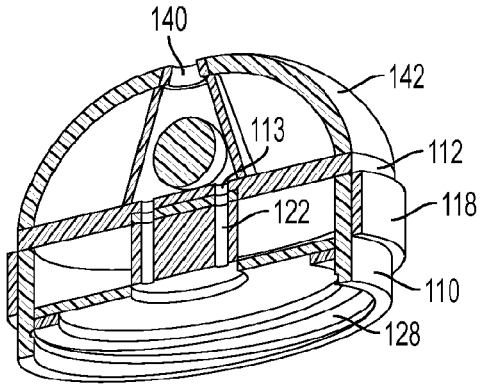
FIG. 7 illustrates a cross-sectional perspective view of the container cap according to an embodiment of the present invention, viewed from an angle below the horizontal.

Example embodiments will now be described more fully with reference to the accompanying drawings, in which example embodiments are shown. In the drawings, the thicknesses of layers and regions may be exaggerated for clarity. Like reference numerals in the drawings denote like elements, and thus their description will not be repeated.

Although detailed illustrative embodiments of the present invention are disclosed herein, the specific structural and functional details disclosed are merely representative for purposes of describing example embodiments of the present invention. The invention, however, may be embodied in many alternate forms and should not be construed as limited to only the embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the invention to the particular forms disclosed, but on the contrary, example embodiments of the invention are to cover all modifications, equivalents, and alternatives falling within the scope of the appended claims.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments of the invention. As used herein, the singular forms "a", "an" and "the" are intended to include the plural forms as well, unless the context clearly indicates otherwise. It will be further understood that the terms "comprises," "comprising," "includes," "including," "has," or "having" when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the FIGS. For example, two FIGS. shown in succession may in fact be executed substantially concurrently or may sometimes be executed in the reverse order, depending upon the functionality/acts involved.

The system of the present invention may, without limitation, be applied to dispense any liquid susceptible to oxygen (air) degradation and/or other gas degradation or deterioration, as well as carbonated liquids. According to the present invention, there is provided a cap and a container capable of being compressed to reduce its effective volume. The collapsible or compressible container may initially be filled with a liquid and then the cap is attached to the container. The cap (hereinafter "container cap") is configured to allow any gas, such as air, to be removed from the container when some liquid in the container is consumed and the container is compressed to reduce its volume in order to compensate for the volume of the consumed liquid.

Figure 8:
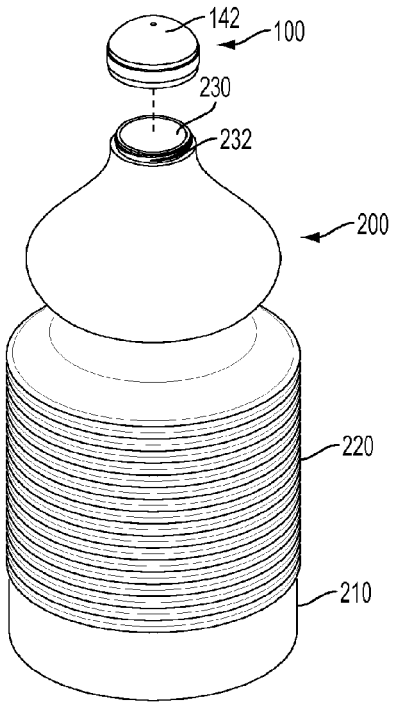
FIG. 8 illustrates a perspective view of the compressible container showing the container cap disengaged from the container.
Figure 9:
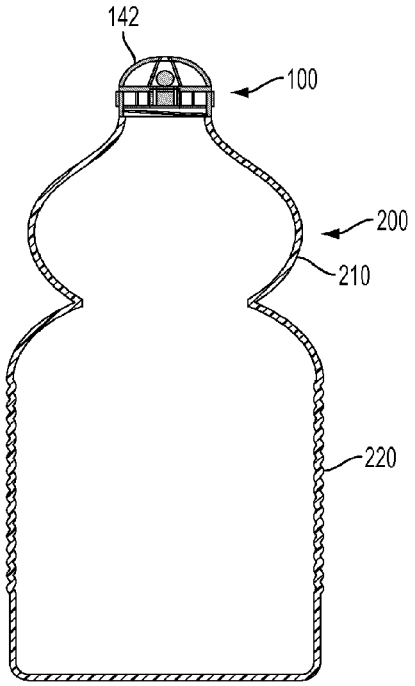
FIG. 9 illustrates a cross-section of a fully expanded compressible container with a container cap engaged with the container, according to an embodiment of the present invention.
Figure 10:
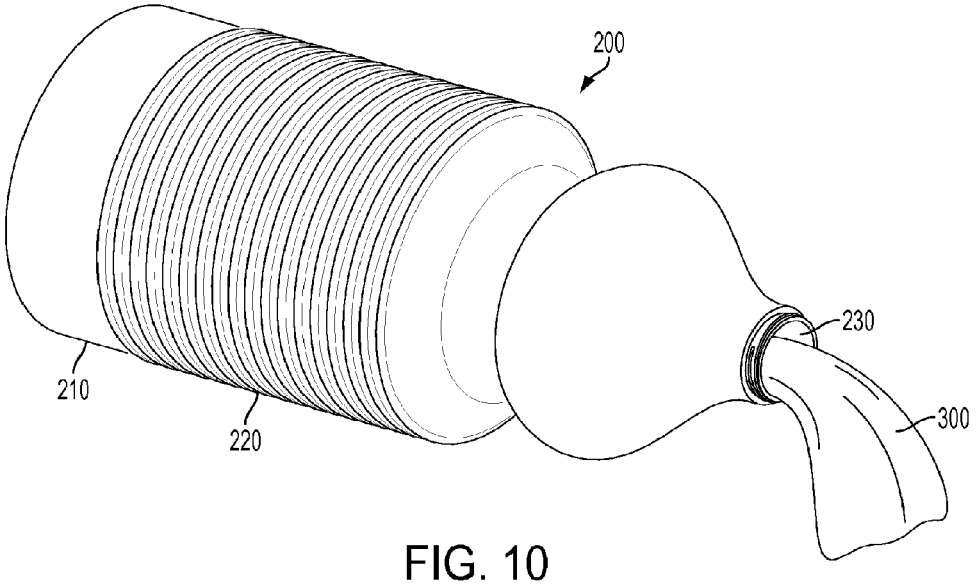
FIG. 10 illustrates liquid being poured out from the compressible container when the container cap is disengaged therefrom.
Figure 11:
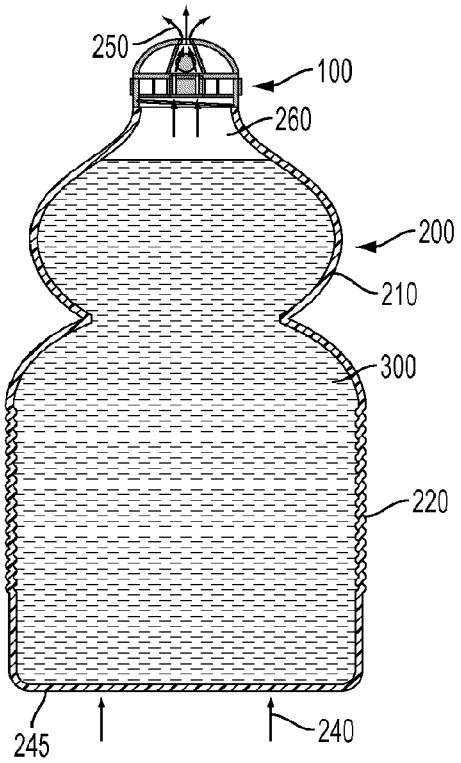
FIG. 11 illustrates the compressible container being compressed with gas from the inside of the compressible container flowing out through the container cap, which is in an open position.
Figure 12:
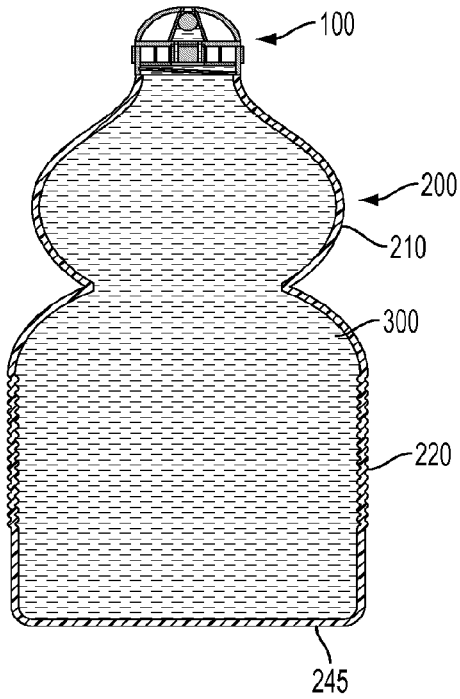
FIG. 12 illustrates the compressible container being compressed shown after all of the air has been expelled and the liquid within the container forces the ball valve in the container cap to close, thereby preventing loss of liquid during compression.

FIGS. 8 and 9 show a compressible container 200 and the container cap 100 that may be used in accordance with one embodiment of the present invention. The container 200 has a body 210 with a compressible section 220 and an opening 230. The container cap 100 is preferably screwed onto the opening 230 of the container 200 in a conventional manner (see FIG. 8), but may be removably engaged with the opening 230 of the compressible container 200 in any desired manner. The liquid 300 within the bottle may be consumed in the manner shown in FIG. 10. To consume the liquid 300, the container cap 100 is removed from the opening 230 of the container 200 (as shown in FIG. 8) and the liquid 300 is poured from the container 200 in a conventional manner (as shown in FIG. 10). After a desired amount of liquid 300 has been consumed, the container cap 100 is returned to the opening 230 of the container 200. As the container 200 is now partially empty, it may be compressed so as to diminish the volume of the container 200 for the purpose of convenience of storage, or for any other desired reason. FIGS. 11 and 12 show the container in the process of compression—see arrows 240 indicating the compressive force against the bottom 245 of the container 200. The compressible section 220 is constructed so as to allow it to accordion or otherwise compress when the container 200 is compressed in the direction shown by the arrows 240 in FIG. 11, resulting in the configuration shown in FIG. 12. In order to allow the air within the container to escape while the container 200 is being compressed to its compressed configuration, the container cap 100 is used, which is shown in greater detail in FIGS. 1-7 and 14.

A preferred embodiment of the container cap according to the present invention is provided in FIGS. 1-7 and 14. As shown, the container cap 100 has an upper surface 142, which in the ornamental construction shown in FIGS. 1-7 and 14 is in the shape of a dome. It should be understood, however, that any other shape could also be used without departing from the essentials of the present invention. The upper surface 142 includes a surface hole 140 from which air may escape. While one such surface hole 140 is shown, it should be understood that more than one such hole may be present.

The container cap includes a first valve 150 that permits fluid communication between the opening 230 of the container 200 and the surface hole 140 when the first valve is in a first position, and prevents fluid communication between the opening 230 of the container 200 and the surface hole 140 when the first valve is in a second position. In one embodiment of such a first valve, the container cap includes two overlapping disks, an upper disk 112 and a lower disk 120. The upper disk 112 has a plurality of holes (perforations) 113 and the lower disk 120 has an equal number of such holes (perforations) 122. The number of such holes may vary, although four are shown in the present figures. The holes 113, 122 in the upper and lower disks 112, 120 are configured to align with each other upon rotation of either one of the disks 112, 120 to a particular aligned position. In this aligned, or open, position of the upper and lower disks 112, 120, the holes 113 and 122 align with one another and a channel is formed through the aligned holes 113, 122. This channel allows fluid communication from the interior of the container 200, through the aligned holes 113, 122 in the upper and lower disks 112, 120 and on to the surface hole 140, as shown, for example, by the arrows 250 in FIG. 11. This fluid communication between the inside space of the container 200 to the outside space allows gas to flow in and out of the container. By compressing the container in the manner shown in FIG. 11, the liquid 300 that remains within the container 200 will force the air in the space 260 above the liquid level in an upward direction and the air will flow out of the container through the aligned holes 113, 122 and the surface hole 140, as shown, for example by arrows 250 in FIG. 11.

Once the liquid 300 reaches the top of the container 200, one of the disks 112, 120 is rotated so that the upper and lower disks 112, 120 are in a second relative position (i.e., a closed position). In the closed position, the holes 113, 122 in the upper and lower disks 112, 120 are misaligned with respect to each other and no gas can pass through the disks 112, 120 and thus no gas can flow in or out of the container. Accordingly, when the disks 112, 120 are rotated to the closed position, the fluid communication channel is closed. When the container 200 is finished collapsing, a disk of the container top is rotated as shown by arrow 260 in FIG. 14 so as to close the channel and prevent air from re-entering the container 200. As a result of this operation, the container 200 has a reduced size, and there is less space and/or no space left for gas within the container. The reduction of the space for the gas may facilitate storing of the container (i.e., through reducing the volume of the container) and/or reduce the deterioration rate of liquids susceptible to oxygen and/or other gaseous substance and prevent the loss of carbonation in carbonated liquids.

In the preferred embodiment shown in FIGS. 1-7 and 14, the disk 120 is designed as a wheel with an outer cylindrical portion 118 and a plurality of spokes 116, four of which are illustrated as spokes 116A, 116B, 116C and 116D. The hub 124 of the wheel (disk 120) is in the center and contains the through-holes 122. A cylindrical element 110 is provided with slots 108 (illustrated as 108A, 108B . . . ) between upstanding portions illustrated as 110A-110D. The circumference of the cylindrical portion 118 of the disk 120 is slightly larger than that of the cylindrical element 110 so that the latter can nest within the outer element 118 of disk 120. The spokes 116 of the disk 120 fit into the slots 108 of the cylindrical element 110 so that the sides of the slots 108 will limit rotation of the spokes 116. As seen most clearly in FIGS. 5-7 and 14, the cylindrical element is preferably glued or otherwise fastened to the disk 112 after being inserted into the disk 120 and the disk 112 is preferably glued or otherwise fastened to the upper surface 142. A disk 114, which may be a gasket, fits within the circumference of the element 110 to close off the interior of disk 120 from the liquid. Disk 114 may be held in place by a flange 126, which is fixed to the inner circumference of the element 110, or disk 114 may be directly glued or otherwise affixed to the inner circumference of element 110. The bottom of the inner circumference of element 110 is screw-threaded to permit engagement with the screw-threads 232 of the container 200.

Figure 14:
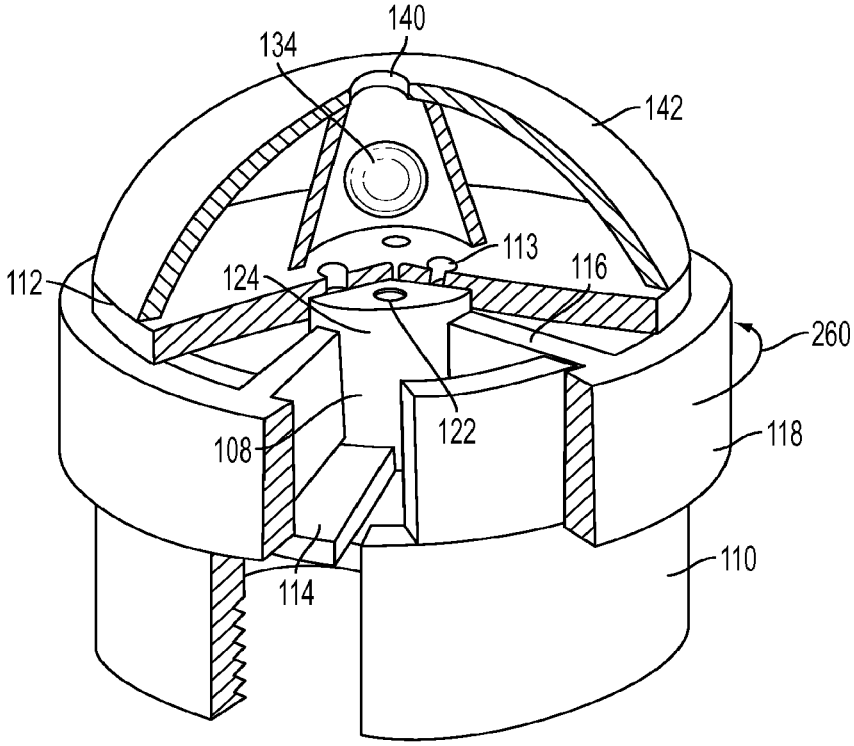
FIG. 14 shows a partially broken-away perspective view of an embodiment of the container cap of the present invention.

The disk 120 is free to rotate with respect to the remainder of the cap, which is fixed in place once screwed onto the container 200. This allows the disk 120 to be rotated with respect to the disk 112 within the confines of slots 108 so that when in one extreme position, such as is shown in FIG. 14, the through-holes 122 and 113 are aligned and the valve 150 is open, and when rotated to the other extreme position, such as is shown after rotation in the direction shown by arrow 260 in FIG. 14, the slots 108 allow the spokes to rotate enough to prevent alignment of the through-holes 122 and 113 and thus close the valve 150.

It should be emphasized that while the illustrated embodiment is a preferred embodiment, the present invention is intended to include any construction of a first valve that will permit the channel to be open when in a first position and closed when in a second. It is within the skill of those of ordinary skill in the art of valves to design alternative constructions of such a first valve that will maintain the desired function.

In a preferred embodiment according to the present invention, the container cap 100 further comprises a second valve 130 to prevent liquid 300 from flowing through the fluid communication channel. Thus, the second valve 130 allows gas passing through the first valve 150 to be expelled through surface hole 140 when the first valve 150 is in the open position. However, when all of the air has been expelled and the liquid 300 tries to pass through the open first valve 150, the second valve 130 will prevent the liquid from passing through the surface hole 140.

Figure 13:
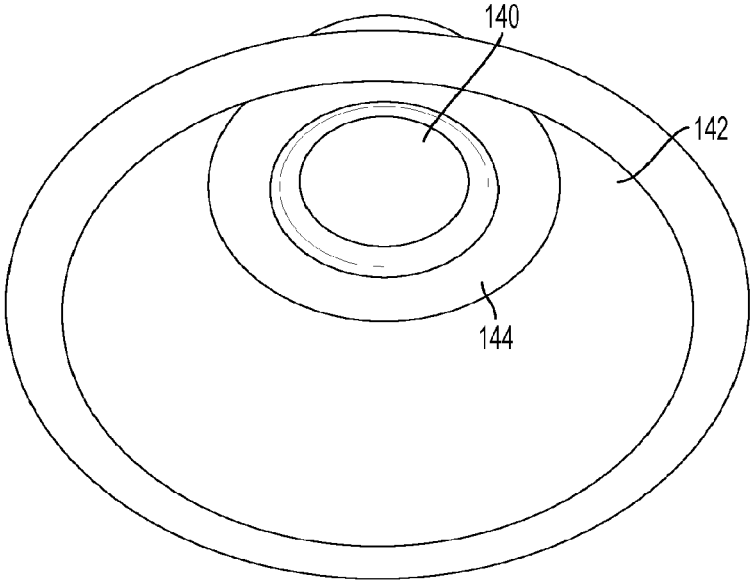
FIG. 13 shows a perspective view, from below, of the inside of the dome of the container cap in an embodiment that includes a built-in gasket.

In a particularly preferred embodiment, the second valve 130 is positioned above the upper disk (see FIGS. 1-7 and 14) of the first valve 150. The second valve 130 includes a tube 132, in the shape of a conic section, that fits between the upper disk 112 and the upper surface 142. The lower end 138 of the tube 132 surrounds the holes 112 in the upper disk 112, and the upper end 136 of the tube 132 surrounds the surface hole 140 on the upper surface 142. The lower end 138 is the larger diameter portion of the conic section tube 132 and the upper end 136 is the smaller diameter portion of the conic section tube 132. The tube 132 is effectively sealed to the upper disk 112 and the upper surface 142 to substantially prevent any fluid communication from the interior to the exterior of the tube 132 within the container cap 100. FIG. 13 shows a view of the upper surface 142 from below. In this preferred embodiment, an elastomeric material 144 is made a part of the upper surface 142 surrounding the hole 140 so as to create a kind of a gasket when in engagement with the upper surface 136 of the tube 132, thereby forming a seal that prevents leakage.

A ball 134 is positioned within the tube 132. The diameter of the ball 134 is smaller than that of the lower side 138 of the tube 132 but larger than that of the upper side 136 of the tube 132. The ball 134 within the conic section tube 132 of the second valve 130 preferably has a specific weight and/or has a density smaller than that of the liquid 300 intended to be kept in the container 200, such that it is capable of floating on the liquid 300. Upon rotating one of the disks 112, 120 of the first valve 150 to the open position and compressing the container 200, as shown in FIG. 11, the gas inside the container 200 within the open space 260 is pushed up and flows out of the container through the channel (i.e., through the aligned holes 113, 122, around the ball 134, and out of the surface hole 140). When all of the gas has flown out, the liquid will reach to the top of the container 200 and begin to flow into the container cap 100. However, the ball 134 prevents the loss and waste of such liquid during compression of the container 200. When the liquid 300 reaches the ball 134, the ball 134 will be forced up by the liquid 300 until it contacts the inside surface of the tube 132, which will prevent liquid 300 from passing by the ball 134 and thus effectively cause the second valve 130 to close, as is shown in FIG. 12. As a result, the liquid 300 is prevented from flowing out from the container cap 100. When this happens, the container will compress no farther and the first valve 150 is then closed, preferably manually. In the illustrated embodiment, one of the disks 112, 120 is rotated to the closed position, as shown by arrow 260 in FIG. 14. Once closed, no carbonation can escape the container 200 and no outside air can reenter. Furthermore, there will be no air, or other gas, within the container 200 that might cause deterioration or degradation of the quality of the liquid 300 therewithin.

It should be emphasized that while the illustrated embodiment is a preferred embodiment, the present invention is intended to include any construction of a second valve that will permit the passage of air but will prevent the passage of liquid. It is within the skill of those of ordinary skill in the art of valves to design alternative constructions of such a second valve that will maintain the desired function.

The shape of the compressible container 200 and the particular construction of the compressible section 220 thereof are not important, as long as compression is possible. For example, the container may be a foldable PET bottle as described in WO02/47988. The PET (polyethylene terephthalate) bottle may comprise a plurality of folding lines around its side walls in such a way that the container is capable of being folded along the folding lines in a state wherein the volume thereof is minimized. Generally a PET bottle may be formed in any desirable manner, such as by a blow molding technique.

Other foldable containers that may also be used, without limitation, with the container cap of the present invention are the bottles as described in WO2005/061336, FR2607109, U.S. Pat. No. 5,333,761, US2009/0057321, U.S. Pat. No. 5,310,068, U.S. Pat. No. 6,116,448, WO96/05113, WO2008/022605, and WO2009/081167.

Whilst the present invention has been described above according to its preferred embodiments, it can be modified within the spirit and scope of this disclosure. This invention is therefore intended to cover any variations, uses, or adaptations of the present invention using the general principles disclosed herein. Further, the instant invention is intended to cover such departures from the present disclosure as come within the known or customary practice in the art to which this invention pertains and which fall within the limit of the following claims. The invention claimed is:

The invention claimed is:

1. An apparatus comprising:

a compressible container having an opening and a compressible portion constructed such that the container is capable of being compressed to a reduced volume; and a cap configured to engage with the opening of the compressible container, said cap comprising:

a surface with an aperture therein, a first valve that permits, when said cap is engaged on said container, fluid communication between said container and said aperture when said first valve is in a first position, and prevents fluid communication between said container and said aperture when said first valve is in a second position, wherein said first valve comprises a first disk and a second disk in engagement with one another, each disk having at least one hole therethrough, wherein said first disk is rotatable with respect to said second disk between a first position and a second position, and wherein the holes of said first and second disks align with each other in the first position to permit fluid to flow therethrough and the holes of said first and second disks misalign with each other in the second position to prevent fluid from flowing therethrough, and a second valve that, when said cap is engaged on said container and said first valve is in said first position, permits gas to flow through said aperture but prevents liquid from flowing therethrough.

2. An apparatus according to claim 1, wherein said second valve comprises a conic section tube and a ball inside the conic section tube, said conic section tube having a first end with a first diameter and a second end with a second diameter that is larger than said first diameter, wherein the diameter of said ball is intermediate said first and second diameters of the ends of said conic section tube, and wherein said conic section tube is situated between the holes of said disks and the aperture in the surface of said cap.

3. An apparatus according to claim 2, wherein the ball has a weight such that it does not close said second valve when gas is flowing through said holes in said disks, but is forced to engage the walls of said conic section tube and close said second valve when liquid is flowing through the holes of said disks.

4. A cap, comprising:

a first end capable of engaging the opening of a container;

a second end being a surface with an aperture therein;

a first valve that permits, when said cap is engaged on a container, fluid communication between the container and said aperture when said first valve is in a first position, and prevents fluid communication between the container and said aperture when said first valve is in a second position, wherein said first valve comprises a first disk and a second disk in engagement with one another, each disk having at least one hole therethrough, wherein said first disk is rotatable with respect to said second disk between a first position and a second position, and wherein the holes of said first and second disks align with each other in the first position to permit fluid to flow therethrough and the holes of said first and second disks misalign with each other in the second position to prevent fluid from flowing therethrough; and a second valve that, when said cap is engaged on the container and said first valve is in said first position, permits gas to flow through said aperture but prevents liquid from flowing therethrough.

5. A cap according to claim 4, wherein said second valve comprises a conic section tube and a ball inside said conic section tube, said conic section tube having a first end with a first diameter and a second end with a second diameter that is larger than said first diameter, wherein the diameter of said ball is intermediate said first and second diameters of the ends of said conic section tube, and wherein said conic section tube is situated between the holes of said disks and the aperture in the surface of the cap.

6. A cap according to claim 5, wherein the ball has a weight such that it does not close said second valve when gas is flowing through said holes in said disks, but is forced to engage the walls of said conic section tube and close said second valve when liquid is flowing through the holes of said disks.

* * * * *